United States Patent [19]

Capelli

[11] Patent Number: 4,798,413

[45] Date of Patent: Jan. 17, 1989

[54] TRAY DEVICE

[76] Inventor: Edward J. Capelli, 7317 31st Ave., Kenosha, Wis. 53142

[21] Appl. No.: 48,514

[22] Filed: May 1, 1987

Related U.S. Application Data

[63] Continuation of Ser. No. 788,937, Oct. 17, 1985, abandoned.

[51] Int. Cl.[4] ..... A47C 7/62

[52] U.S. Cl. ..... 297/194; 297/161; 297/188; 108/26

[58] Field of Search ..... 297/194, 127, 128, 145, 297/153, 154, 155, 173, 174, 160, 161, 162, 185, 188; 108/6, 26, 31, 154; 248/224.3, 225.1, 224.4, 73, 500, 501

[56] References Cited

U.S. PATENT DOCUMENTS

| | | | |
|---|---|---|---|
| 1,220,299 | 3/1917 | Viden . | |
| 1,634,929 | 7/1927 | Blitz et al. | 297/161 |
| 2,100,597 | 11/1937 | Pickle et al. | 297/161 |
| 2,375,565 | 5/1945 | Liakopulos | 248/282 |
| 2,711,830 | 6/1955 | Howell | 108/26 |
| 2,994,366 | 8/1961 | Hoch | 248/230 |
| 3,050,280 | 8/1962 | Regan | 248/40 |
| 3,116,046 | 12/1963 | Risdon | 248/231 |
| 3,166,354 | 1/1965 | Sorensen | 297/194 |
| 3,267,887 | 8/1966 | Boyd | 297/194 X |
| 3,338,628 | 8/1967 | Evans | 297/188 |
| 3,494,661 | 2/1970 | Leyburn | 297/188 |
| 3,586,367 | 6/1971 | Cincotta | 297/162 |
| 3,878,589 | 4/1975 | Schaefer | 248/225.1 X |
| 4,003,598 | 1/1977 | Glaze | 297/194 |
| 4,300,798 | 11/1981 | Musgrove et al. | 297/184 |
| 4,314,685 | 2/1982 | Schwan | 108/6 X |
| 4,422,640 | 12/1983 | Tamarkin | 108/25 X |
| 4,524,701 | 6/1985 | Chappell | 297/188 X |

FOREIGN PATENT DOCUMENTS

| | | | |
|---|---|---|---|
| 267797 | 4/1968 | Austria | 297/154 |
| 658077 | 6/1938 | Fed. Rep. of Germany | 108/26 |
| 852697 | 10/1960 | United Kingdom | 297/162 |

*Primary Examiner*—Francis K. Zugel
*Assistant Examiner*—Laurie K. Cranmer
*Attorney, Agent, or Firm*—Quarles & Brady

[57] ABSTRACT

A tray device is presented which can be easily secured to or removed from the supporting arm of a piece of furniture such as a lawn chair. The tray and the arm provide a snap-fit arrangement which also affords a pivoting or swiveling for the tray on the lawn chair. The combined snap-fit and swivel arrangement is afforded by an annular flange member extending from the bottom of the tray. A base member is supported by the lawn chair which has an arcuate undercut to receive a portion of the annular flange as well as a portion opposite the undercut for retaining the annular flange in the base member. A cup or glass receiving compartment is formed with the tray and positioned over the flange member to add stability to the tray when it is engaged by the base member.

10 Claims, 1 Drawing Sheet

FIG. 1.
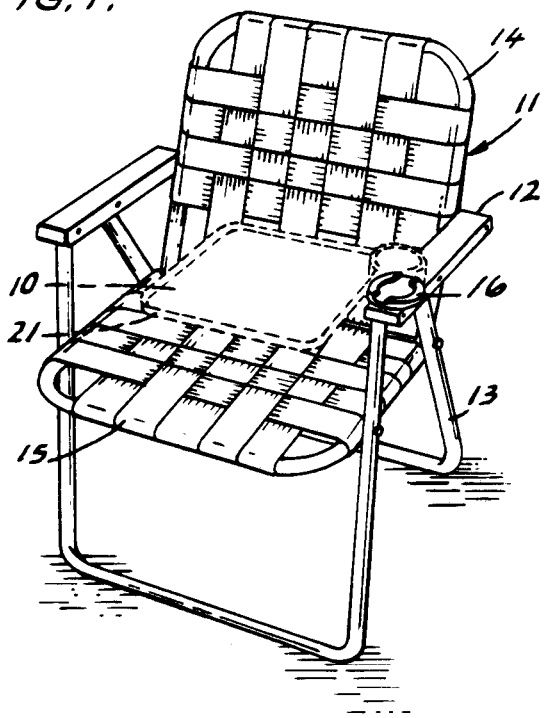
FIG. 2.
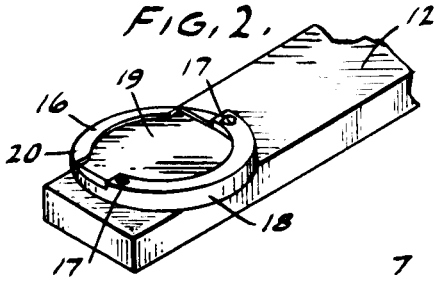
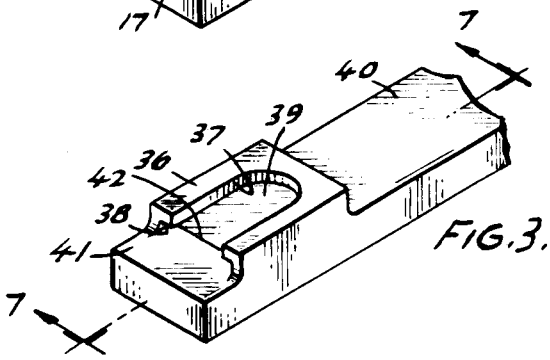
FIG. 3.
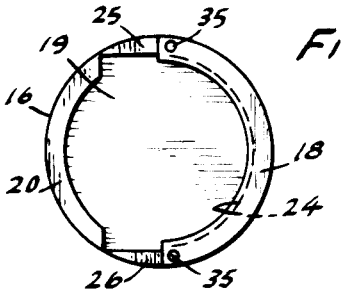
FIG. 4.
FIG. 5.
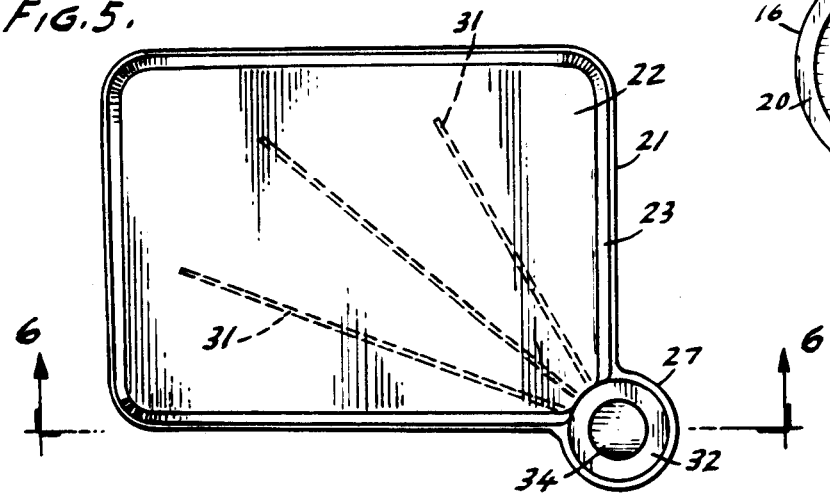
FIG. 6.
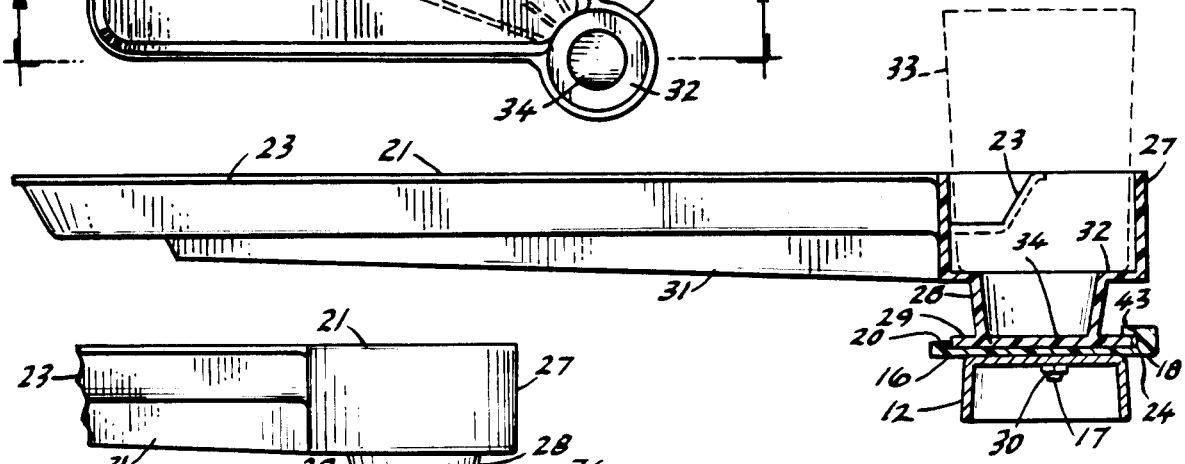
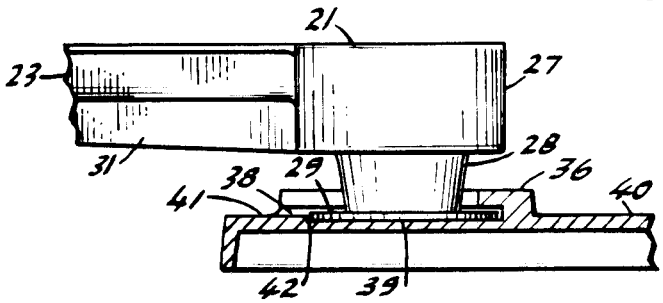
FIG. 7.

TRAY DEVICE

This application is a continuation, of application Ser. No. 788,937, filed Oct. 17, 1985 now abandoned.

BACKGROUND OF THE INVENTION

This invention relates to a tray device which can be easily connected to or removed from a piece of furniture as well as rotated or swiveled in connection with it. More particularly, the invention relates to a tray member and a supporting base member wherein a combined snap-fit and pivotal arrangement is provided as well as a receptacle receiving compartment which adds stability to the tray.

Removable and pivotal tray members are known for attachment to the arm of a chair. For example, in U.S. Pat. No. 2,375,565 an ashtray 25 is mounted on a chair arm 10. The ashtray is carried by a head member 18 from which extends a pivot or mounting pin 16 in sleeve 15. A rotary tray attachment for folding chairs is described in U.S. Pat. No. 2,994,366. In this particular unit, a wing nut 34 is employed in conjunction with a clamp 30 to provide attachment to the chair as well as a spring leaf 57 and a strap 22 with an associated thumb set screw 26. In U.S. Pat. No. 3,116,046 a refreshment holder is described which is attached to the arm of a chair by the means of spring clips 12 and 13. A clip-on tray is illustrated in U.S. Pat. No. 3,494,661 with an insert portion 14 fitting between the leg 20 and the tubular member 18 with a rivet 24 being accommodated in the slot 16 of the insert portion. U.S. Pat. Nos. 3,586,367 and 4,300,798 illustrate threaded clamping or pivotal attachments for tray members and chairs.

Many of the tray or holder units described in the previously referred to patents require the manipulation of various component parts. Others do not afford a secure attachment for a tray which is designed to hold large quantites of food and beverages.

It is an advantage of the present invention to provide a tray device which can be readily attached to and disconnected from a piece of furniture such as a chair, yet at the same time be pivotal or rotatable therewith. Another advantage of the tray device of this invention is the previously referred to pivotal attachment between a chair and the tray which does not require the fastening of securing elements such as threaded screws or wing nuts. A still further advantage of the present invention is a tray device which can be secured to the arm of a lawn chair in a snap-fit arrangement, yet at the same time afford a pivoting thereof. Other advantages are a tray of the foregoing type which is manufactured with only two components that provide a stable rotation of the tray in conjunction with a chair when it is utilized to support beverage or food items, as well as a tray device for attachment to a chair which can be manufactured in an economical manner.

SUMMARY OF THE INVENTION

The foregoing advantages are accomplished and the shortcomings of the prior art are overcome by the present tray device for attachment to a base member secured to or operatively associated with a supporting structural member such as the arm of furniture. A tray device is attached to the base member in a combined snap-fit and pivotal means constructed and arranged to permit the tray member to be interconnected to the base member in a swivel manner without additional fastening elements. In a preferred embodiment, the snap-fit and pivotal means is provided in part by an arcuate undercut portion in the base member and an annular flange member operatively spaced from the tray device. The annular flange member is positioned outwardly from a portion of the tray member providing a supporting surface for food and beverage containing utensils. In one particular embodiment, a hollow cup or glass receiving compartment extends in a direction opposite from the flange member and radially disposed support members extend between the compartment and the bottom of the tray. Also preferably, the cup or glass receiving compartment is formed with the tray as a one piece unit.

BRIEF DESCRIPTION OF THE DRAWINGS

A better understanding of the present tray device may be accomplished by reference to the drawing wherein:

FIG. 1 is a perspective view showing the tray member of the tray device in broken lines and as it would be fitted onto a typical lawn chair.

FIG. 2 is an enlarged view of the base member of the tray device for securing the tray member to the arm of the lawn chair shown in FIG. 1.

FIG. 3 is a view similar to FIG. 2 except showing an alternative embodiment.

FIG. 4 is an enlarged top plan view of the base member shown in FIG. 2.

FIG. 5 is an enlarged top plan view of the tray member.

FIG. 6 is an enlarged view taken along line 6—6 of FIG. 5 and showing a water glass in broken lines positioned in conjunction with the tray device.

FIG. 7 is a partial view similar to FIG. 6 except showing an alternative embodiment.

DESCRIPTION OF THE PREFERRED EMBODIMENTS

Proceeding to a detailed description of the present invention, the tray device generally 10 is shown in conjunction with a standard lawn chair 11 having an arm rest 12 with foldable legs 13 and a back 14 as well as a seat 15. The tray device includes a tray member 21 which is shown in broken lines in FIG. 1 and is constructed to be rotatably attached to the base member 16 on the arm rest 12.

As best seen in FIG. 2, the base member 16 is a separate component secured to the horizontally positioned arm rest 12 by the screws 17 and includes an arcuate portion 18 surrounding a base floor 19. The base member 16 also has an arcuate raised flange 20 disposed oppositely the arcuate portion 18 but of a lower height. Interconnecting the arcuate portion 18 and the arcuate flange 20 are two ridge intermediate portions 25 and 26. This is best seen in conjunction With FIG. 4 where it will also be noted that the arcuate portion has an undercut 24 arcuately placed in the arcuate portion 18.

Referring specifically to FIG. 5, the tray member 21 is depicted having the usual floor portion 22, as well as an upstanding peripheral ridge 23. Extending outwardly and off-set from the floor portion 21 is a compartment 27 which is generally cylindrical in configuration. It has a circular center portion 34 at the bottom thereof surrounded by an intermediate annular section 32. Extending outwardly from the compartment 27 and under the tray member 21 are three radially extending support members 31. One of the support members 31 is specifically shown in FIG. 6.

Referring to FIG. 3, an alternative base member 36 is depicted. Unlike base member 16 it is integrally molded into the arm rest 40. It has a U-shaped slot 37 also with a U-shaped undercut 38 surrounding the floor 39. A raised portion 41 is positioned at the end of the base member and has a retaining lip 42 formed therein. This is best seen in FIG. 7.

FIG. 6 depicts the positioning of the tray member 21 in contact with the base member 16 as secured on the arm 12. It will be noted that nuts such as 30 will engage the threaded portion of the screens 17 for this purpose. It will be noted that disposed from the lower portion 28 of the compartment 27 is a circular flange 29. This flange 29 is designed so that it can be fitted under the undercut 24 of the base member 16 in a snap-fit type arrangement. As will be seen in FIG. 6, once a portion of the flange 29 is positioned under the lip 43 it will be retained therein by opposing linear engagement with the arcuate flange 20 while resting on the floor 19.

The same type of snap-fit retention is afforded between the tray member 21 and the base member 36 formed in the arm rest 40 depicted in FIGS. 3 and 7. The only difference is that the flange 29 at the bottom of the compartment 27 will be moved into the undercut 38 disposed in the base member 36 and surrounding the U-shaped slot 37. Retention will be afforded therein by the raised portion 41 forming a lip 42 for retaining the flange in the base member 36 when it is seated against the floor 39.

It will be seen that there are several important features of the tray device 10 of this invention whether it be employed in conjunction with the base member 16 or 36. To utilize the tray all that is required is the snap-fitment of the flange 29 into the respective base members and their respective undercuts 24 or 38. This is accomplished by merely orientating the flange 29 at a slight angle with respect to the floors 19 and 39 and their respective undercuts 24 and 38 with sufficient opening being afforded in the undercuts so as to permit the opposing portions of the flange to clear over the arcuate flange 20 or the raised portion 41. With the flange placed against the floors 19 or 39, pivotal action of the flange in a retentive manner is afforded in the undercuts 21 and 38 and against the arcuate flange 20 and lip 42 of the respective base members. To remove the tray member 21 from the base portions 16 and 36, the reverse procedure is instituted with the flange being raised slightly upwardly over the arcuate flange 20 or the raised portion 41 and lifted thereover in a direction opposite the arcuate portion 18 or the slot 37.

From the foregoing procedure it will be seen that the tray device can be easily secured to a base member on a lawn chair 11 without employing any loose parts such as screws, bolts or wing nuts. Another important aspect of this invention in conjunction with the previously described snap-fit and rotatable retention is the fact that the compartment 27 of the tray member 21 is offset and outwardly from the tray floor portion 22. This positioning places it over the flange 29 where the rotation and the retention of the tray member 21 is effected. This affords a counter balance type weight effect. It will be appreciated that the weight of the fluid contents of the glass 33 in the compartment 27 will counter balance the weight of the food items or other items placed on the tray floor portion 22.

The preferred material for forming the tray member 21 and the compartment 27 in a one piece unit as well as the base members 16 or 36 is a semi-rigid plastic material. However, other materials such as metal could be utilized and still effect the previously described snap-fit and swivel arrangement.

While the tray member apparatus has been shown in conjunction with a lawn chair 11, it will be appreciated that the snap-fit swivel arrangement as afforded between the flange 29 and the base members 16 or 36 could be utilized in conjunction with any type of supporting surface for the base members such as the arms of various types of furniture such as kitchen chairs, seat type chairs in vehicles such as campers, trains, airplanes, a youth chair or couches.

It will thus be seen that through the present invention there is now provided a tray device which can be easily fitted onto a support and provides a swivel type action wherein it can be moved out of the way for access to and egress from a chair. The tray device apparatus is simple in its construction and requires no loose parts or assembly or disassembly procedures in conjunction therewith. It is rigid in its construction so as to support a relatively large weight yet is counter balanced with the placement of food items and liquid beverages in conjunction with it.

The foregoing invention can now be practiced by those skilled in the art. Such skilled persons will know that the invention is not necessarily restricted to the particular embodiments presented herein. The scope of the invention is to be defined by terms of the following claims as given meaning by the preceding description.

I claim:

1. A tray device for attachment to a supporting structural member such as the arm of furniture:

a base member adapted to be connected to said supporting structural member;

a tray member;

said base member and said tray member including an undercut portion and a raised portion on one of said base or tray members and a flange for fitting between said undercut portion and said raised portion on the other of said base or tray member to provide a combined snap-fit and pivotal means arranged to permit the tray member to be interconnected to said base member in a swivel manner without substantial longitudinal movement with respect to said arm and any additional fastening elements; and a hollow cup or glass receiving compartment extending oppositely from said flange member when said flange is placed between said undercut and raised portion.

2. The tray device for attachment to a supporting structural member as defined in claim 1 wherein said snap-fit and pivotal means is defined in part by an undercut portion in said base member and an annular flange member extending from said tray member.

3. The tray device for attachment to a supporting structural member as defined in claim 2 wherein said annular flange member is spaced from and integrally connected to a portion of said tray member providing a supporting surface for food and beverage containing utensils.

4. The tray device for attachment to a supporting structural member as defined in claim 2 wherein said undercut portion is of an arcuate configuration and placed in an arcuate portion of said base member and said raised portion is defined by a raised arcuate flange section positioned opposite to said arcuate undercut portion.

5. The tray device for attachment to a supporting structural member as defined in claim 4 further including two oppositely disposed intermediate portions positioned between said raised arcuate flange section and said undercut portion.

6. The tray device for attachment to a supporting structural member as defined in claim 2 wherein said undercut portion is disposed adjacent a substantially U-shaped slot in said base member and said raised portion is defined by a lip member extending transversely to said slot.

7. The tray device for attachment to a supporting structural member as defined in claim 1 further including radially disposed support members extending between said compartment and the bottom of said tray member.

8. The tray device for attachment to a supporting structural member as defined in claim 1 wherein said cup or glass receiving compartment is formed with said tray member as a one piece unit and said compartment is axially aligned with said flange member.

9. The tray device for attachment to a supporting structural member as defined in claim 8 wherein said one piece unit is formed of a plastic material.

10. The tray device for attachment to a supporting structural member as defined in claim 1 wherein said base member is formed as a separate component from said supporting structural member.

* * * * *